US010032548B2

(12) United States Patent
Wang et al.

(10) Patent No.: US 10,032,548 B2
(45) Date of Patent: Jul. 24, 2018

(54) PREPARATION METHOD OF ORIENTED HIGH SILICON STEEL

(71) Applicant: NORTHEASTERN UNIVERSITY, Shenyang, Liaoning Province (CN)

(72) Inventors: Guodong Wang, Shenyang (CN); Yuanxiang Zhang, Shenyang (CN); Yang Wang, Shenyang (CN); Xiang Lu, Shenyang (CN); Feng Fang, Shenyang (CN); Guangming Cao, Shenyang (CN); Chenggang Li, Shenyang (CN); Guo Yuan, Shenyang (CN); Yunbo Xu, Shenyang (CN); Zhenyu Liu, Shenyang (CN); Zhaodong Wang, Shenyang (CN)

(73) Assignee: NORTHEASTERN UNIVERSITY, Shenyang, Liaoning Province (CN)

( * ) Notice: Subject to any disclaimer, the term of this patent is extended or adjusted under 35 U.S.C. 154(b) by 351 days.

(21) Appl. No.: 15/027,368

(22) PCT Filed: Oct. 20, 2014

(86) PCT No.: PCT/CN2014/088887

§ 371 (c)(1),
(2) Date: Apr. 5, 2016

(87) PCT Pub. No.: WO2016/045157

PCT Pub. Date: Mar. 31, 2016

(65) Prior Publication Data

US 2016/0247613 A1 Aug. 25, 2016

(30) Foreign Application Priority Data

Sep. 28, 2014 (CN) ..... 2014 1 0505834

(51) Int. Cl.
*H01F 1/147* (2006.01)
*C21D 8/12* (2006.01)
(Continued)

(52) U.S. Cl.
CPC ..... *H01F 1/14766* (2013.01); *B22D 11/001* (2013.01); *B22D 11/041* (2013.01);
(Continued)

(58) Field of Classification Search
CPC ..... H01F 1/14766; C22C 38/12; C22C 38/06; C22C 38/04; C22C 38/02; C21D 8/0405;
(Continued)

(56) References Cited

U.S. PATENT DOCUMENTS 5,415,703 A 5/1995 Ushigami et al.

FOREIGN PATENT DOCUMENTS

CN 1560309 A 1/2005
CN 102041368 A 5/2011
(Continued)

OTHER PUBLICATIONS

Takada, Y., et al, "Commercial scale production of Fe-6.5 wt. % Si sheet and its magnetic properties", Journal of Applied Physics, 1988, 64, pp. 5367-5369.

(Continued)

*Primary Examiner* — Jessee Roe
(74) *Attorney, Agent, or Firm* — Muncy, Geissler, Olds & Lowe, P.C.

(57) ABSTRACT

The preparation method includes steps of (1) melting steel according to in weight percentage 0.001-0.003% of C, 5.0-6.6% of Si, 0.2-0.3% of Mn, 0.05-0.12% of Al, 0.01-0.04% of V, 0.03-0.06% of Nb, 0.02-0.03% of S, 0.009-0.020% of N, O which is less than or equal to 0.0020%, and the balance being Fe and unavoidable impurities; (2) forming cast strips after a thin-strip casting course; (3) hot-rolling
(Continued)

the cast strips under inert atmosphere conditions; (4) cooling the hot-rolled cast strips to 550-600 DEG C., coiling and performing low-temperature hot rolling/warm rolling on the coiled cast strips under a nitrogen atmosphere condition; (5) removing oxidized scales though pickling, performing cold rolling multiple times; (6) performing recrystallization annealing, coating with an MgO layer, and coiling; (7) performing purification annealing under hydrogen circulation conditions; and (8) removing oxidized scales, coating with an insulating layer, performing flat stretch annealing, and air-cooled coiling.

3 Claims, 4 Drawing Sheets

(51) Int. Cl.

| | |
|---|---|
| ***C22C 38/12*** | (2006.01) |
| ***B22D 11/00*** | (2006.01) |
| ***B22D 11/041*** | (2006.01) |
| ***C21D 8/04*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***B22D 11/06*** | (2006.01) |
| ***B22D 11/12*** | (2006.01) |

(52) U.S. Cl.

CPC ..... *B22D 11/0622* (2013.01); *B22D 11/1206* (2013.01); *C21D 8/0405* (2013.01); *C21D 8/0415* (2013.01); *C21D 8/0426* (2013.01); *C21D 8/0436* (2013.01); *C21D 8/0463* (2013.01); *C21D 8/0473* (2013.01); *C21D 8/0478* (2013.01); *C21D 8/12* (2013.01); *C21D 8/1205* (2013.01); *C21D 8/1211* (2013.01); *C21D 8/1222* (2013.01); *C21D 8/1233* (2013.01); *C21D 8/1261* (2013.01); *C21D 8/1272* (2013.01); *C21D 8/1277* (2013.01); *C21D 9/52* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C21D 2201/05* (2013.01)

(58) Field of Classification Search

CPC .. C21D 8/0415; C21D 8/0436; C21D 8/0426; C21D 8/0463; C21D 8/0473; C21D 8/0478

See application file for complete search history.

(56) References Cited

FOREIGN PATENT DOCUMENTS

| | | | |
|---|---|---|---|
| CN | 103551532 | A | 2/2014 |
| JP | S 63-69917 | A | 3/1988 |
| JP | S 63-89622 | A | 4/1988 |
| JP | H 4-59929 | A | 2/1992 |
| JP | H 4-80321 | A | 3/1992 |
| JP | H 4-224625 | A | 8/1992 |
| JP | H 5-295447 | A | 11/1993 |

OTHER PUBLICATIONS

Arai, K. I., et al., "Annealing effect on grain texture of cold-rolled 4.5% Si—Fe ribbons prepared by a rapid quenching method", Journal of Applied Physics, 1988, 64, pp. 5373-5375.

Haiji, H., et al., "Magnetic properties and workability of 6.5% Si steel sheet", Journal of Magnetism and Magnetic Materials, 1996, 160, pp. 109-114.

PREPARATION METHOD OF ORIENTED HIGH SILICON STEEL

BACKGROUND OF THE INVENTION

1. Field of the Invention

The present invention belongs to the technical field of metallurgy, and particularly relates to a preparation method of oriented high silicon steel.

2. The Prior Arts

High silicon steel generally refers to Si—Fe alloy of which the silicon content is 4.5-6.5%, but 6.5% Si—Fe alloy has the characteristics of near zero magnetostriction Xs, high magnetic permeability, low coercivity, low iron loss, and especially low high-frequency iron loss, so that the 6.5% Si—Fe alloy becomes an ideal soft magnetic alloy material; however, when the Si content is increased to be 4.5% or more, alloy elongation sharply declines, and the elongation of the 6.5% Si—Fe alloy at room temperature is almost 0.

High silicon steel becomes a hot spot in the research of magnetic materials in recent years, and the research trends are mostly concentrated on formation laws of the ordered phase of non-oriented high silicon steel and trying to explain the causes and improvements on brittleness at room temperature; in Europe, Russia and Japan, there are reports that 6.5% Si non-oriented silicon steel is rolled out by adjusting alloy ingredients and optimizing the design of hot rolling-warm rolling-cold rolling procedure; Beijing University of Science and Technology improves the low-temperature plasticity of the strips by using B and other elements to refine cast structures and to prevent formation of $DO_3$ long-range ordered phase (CN 1560309A). Japanese goes at the forefront in the in-depth research and industrialization sector of the high silicon steel: they carry out a comprehensive study about the improvement of forming properties of 6.5% Si by alloy elements Ni, Al, Mn, etc., and the influence of the adjustment of the rolling course on the forming performance, and propose an idea of obtaining a fiber texture through low temperature hot rolling so as to be convenient to lower temperature deformation (Takada Y, Journal of Applied Physics, 1988, 64, 5367-5369); some scholars even propose a thin strip quick quenching method to obtain high silicon microcrystalline strips which are 0.55 mm or even thinner so as to solve the brittleness problem (Arai K. I, Journal of Applied Physics, 1988, 64, 5373-5375).

Taken together, these methods for obtaining 6.5% Si electrical steel by composition and rolling deformation can solve the difficult problem for rolling forming of non-oriented high silicon steel to some extent, but with limited width and thickness, the microcrystalline thin strips prepared by the thin-strip quick quenching method are almost difficult to achieve industrial-scale production; it is Japanese NKK who truly promotes 6.5% Si non-oriented products to be practical: by using a chemical vapor deposition fast silicon infiltration (CVD) method and a rolling method, they produce 6.5% Si—Fe alloy of 0.1-0.5 mm (Haiji H. Journal of Magnetism and Magnetic Materials, 1996, 160, 109-114), known as "Super Ecore"; 3% Si non-oriented silicon electrical steel finished products are processed through silicon infiltration, then processed with high-temperature heat treatment for homogenization and promoted for grain growth to obtain 6.5% Si non-oriented electrical steel with favorable magnetic properties.

Because of single Goss texture obtained by secondary recrystallization, oriented silicon steel having superior magnetic properties of high magnetic induction and low iron loss in the rolling direction is mainly used for cores of various transformers; according to the conventional oriented silicon steel, the Si content is 2.8-3.4%, the Goss monocrystalline theoretical saturation magnetic induction with the Si content $B_S$ is about 2.03 T, and the value of $B_8$ can directly reflect saturation magnetic induction of the oriented silicon steel sheet; according to the Hi-B (high magnetic induction) oriented silicon steel, $B_8$ is between 1.90 and 1.96 T, $B_8/B_S$ is greater than or equal to 0.936 and smaller than or equal to 0.966, and therefore, the Hi-B (high magnetic induction) oriented silicon steel is the highest level of products in oriented silicon steel.

The oriented high silicon steel has higher maximum permeability, higher resistivity, and lower high-frequency core loss, so that the mass and the volume of electrical components can be significantly reduced, the efficiency of electric appliances is improved, especially for the 6.5% Si—Fe alloy (saturation magnetic induction Bm is equal to 1.80 T), the magnetostriction is almost equal to 0, the noise of high-frequency transformers can be significantly reduced, and the oriented high silicon steel has a very high application value; however, for the preparation of oriented high silicon steel, we also need to solve a large number of technology problems, on one hand, both oriented high silicon steel and non-oriented high silicon steel need to solve the problem of matrix plasticity. On the other hand, the occurrence of complete secondary recrystallization of high silicon steel requires more stringent inhibitor conditions, so that the following factors clearly affect the preparation of the oriented high silicon steel:

1) an Si element can significantly improve the grain boundary migration of Fe—Si alloy and coarsen grains, so that high Si steel billets have a very coarse grain size, reach the level of tens of mm, and are unfavorable for plasticity;

2) the necessary condition for the secondary recrystallization is that the primarily recrystallized grain growth of the steel strips is strongly inhibited, and the increased grain boundary migration rate of cold-rolled high Si steel needs stronger inhibitors; and 3) the inhibitor can be a compound (such as an S compound and an N compound) or a simple substance (such as Cu, Sn, and B), but the former needs to be controlled by high temperature solution and phase change precipitation; billets heated at high temperature can cause crystalline grains to be too roughened; since the high silicon steel is a single phase ferrite, there is no phase transition window to control fine precipitation of the N compound. The simple substance and the compound are often used as auxiliary inhibitors, and when being used alone, the simple substance and the compound have insufficient restraining force, and also easily perform solution strengthening on the matrix, thus affecting plasticity.

Only a few Japanese patents give some reports about preparing the oriented high silicon steel by a conventional procedure: in Sumitomo Metal's patents JP S 63-069917 and 089622, billets of which the thicknesses are 50 mm are subjected to hot rolling-warm rolling-cold rolling to obtain 0.2-0.3 mm strips, and a single MnS, AlN, TiC or VC is used as an inhibitor to obtain 6.5% Si oriented silicon steel, but due to insufficient inhibition force of the inhibitor, secondary recrystallization has a low orientation level, and $B_8/B_S$=1.65 T/1.80 T=0.916; Nippon Steel Corporation increases the amount of AlN by a nitriding method after recognizing the problem of insufficient restraining force, but only enhances the magnetic induction $B_8$ to 1.67 T (JP HO 4-080321, 224625); obviously, these two methods do not break through the constraints of a conventional procedure.

In addition, the silicon infiltration method is also problematic when being used for preparing high-silica-oriented silicon steel: as mentioned above, the diffusion annealing course after a large amount of non-oriented Si is infiltrated in the steel promotes the growth of the crystalline grains, and such grain boundary migration in oriented silicon steel results in the reduction of the degree of orientation, even destroys the original sound secondary recrystallization, and finally cannot get good magnetic properties. There are no published reports in the research results of the current study about magnetic induction.

In twin-roll thin strip casting technique, two rotating casting rolls are used as crystallizers, and liquid molten steel is directly poured into a molten pool formed by the casting rolls and side block panels, and then directly solidified into thin strips of which the thickness is 1-6 mm, without casting, heating, hot-rolling, normalizing and other production working procedures. This technology is characterized in that the liquid metal is crystallized and solidified while undergoing pressure processing and plastic deformation, to complete the whole course conversion from liquid metal to solid thin strips in a very short period of time, at the solidification rate up to $10^2$-$10^4$ DEG C./s, thus greatly refining the size of solidified crystalline grains of high silicon steel. Therefore, thin strip casting has a unique advantage in the production of high silicon Fe—Si alloy; in the respect, Sumitomo Metal Japan has related patent reports: they process 1-2 mm thin strips with casting-high temperature annealing-cold rolling to obtain strong Goss secondary recrystallization tissue; however, their recognition about the thin strip casting is limited, so that the yield of casting strips through direct cold rolling is low besides, the inhibition force of the inhibitors is weaker, and the oriented high silicon steel with superior magnetic induction is not obtained.

SUMMARY OF THE INVENTION

In order to solve the problems existing in a conventional preparation method of oriented high silicon steel, the present invention provides a method for preparing oriented high silicon steel, based on the systematical understanding about tissue-texture-precipitation in near-rapid solidification course of twin-roll thin strip casting of high silicon steel, designs an inhibitor program, and achieves flexible control over tissue-texture-precipitation through the control over crystalline grain solidification-growth behavior of the cast strips and design for the solution and precipitation behaviors of inhibitor elements, to obtain oriented high silicon steel with high magnetic induction.

A preparation method of oriented high silicon steel disclosed by the present invention is performed according to the following steps of:

1. smelting to obtain molten steel according to set components in percentage by weight: 0.001-0.003% of C, 5.0-6.6% of Si, 0.2-0.3% of Mn, 0.05-0.12% of Al, 0.01-0.04% of V, 0.03-0.06% of Nb, 0.02-0.03% of S, 0.009-0.020% of N, O which is less than or equal to 0.0020%, and the balance being Fe and unavoidable impurities;

2. performing a thin strip casting course: enabling the molten steel to be charged through a gate into a tundish which is preheated at the temperature of 1200-1250 DEG C., controlling the superheat temperature to be at 20-50 DEG C., and through the tundish, enabling the molten steel to enter a thin strip caster to be formed into cast strips of which the thickness is 1.8-3.0 mm;

3. after drawing out cast strips, cooling the cast strips to 1000-1050 DEG C. at the cooling rate of 50-100 DEG C./s under inert atmosphere conditions, then performing hot rolling, wherein the primary rolling temperature is 1000-1050 DEG C., the final rolling temperature is 900-980 DEG C., and the rolling reduction is 10-15%, and forming hot-rolled cast strips;

4. cooling the hot-rolled cast strips to 550-600 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 550-600 DEG C., and the total rolling reduction is 70-80%, and forming warm-rolled strips;

5. removing oxidized scales of the warm-rolled strips through pickling, and then performing cold rolling multiple times at 100-200 DEG C., wherein the total rolling reduction is 60-80%; during the cold rolling course, performing aging treatment twice to 3 times, wherein the aging treatment temperature is 280-320 DEG C., and the duration is 240-300 s, and performing aging treatment each time between two adjacent cold rollings, so as to obtain cold rolled strips;

6. performing recrystallization annealing on the cold rolled strips at 840-860 DEG C. for 120-180 s under the condition of nitrogen-hydrogen mixed atmosphere, wherein the dew point of the mixed atmosphere is controlled to be at 30-60 DEG C., then coating with an MgO layer, and finally coiling so as to obtain coated cold-rolled strips;

7. putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1220-1240 DEG C. at the rate of 30-40 DEG C./h, and keeping the temperature for 20-30 h for purification annealing; and 8. performing surface cleaning on the coated cold-rolled strips after purification annealing so as to remove the oxidized scales, then coating with an insulating layer, performing flat stretch annealing at 790-810 DEG C., finally performing air-cooling to be 650 DEG C. or below and coiling so as to obtain the oriented high silicon steel.

The thickness of the oriented high silicon steel is 0.10-0.25 mm.

In the method, the volume concentration of the hydrogen in the mixed atmosphere of nitrogen and hydrogen is 30%.

In the method, the molten steel enters the thin strip caster through the tundish, forms a molten pool in the crystallizer formed by rotating casting rolls and side block panels and is solidified and formed.

The magnetic properties of the oriented high silicon steel: $P_{10/50}$ at 0.18-0.62 W/kg, $P_{10/400}$ at 6.75-9.5 W/kg, magnetic induction $B_8$ at 1.74-1.81 T, and $B_8/B_S$=0.961-0.978.

The present invention, finished under the funding from the National Natural Science Foundation of China (U1260204 51174059), is innovative in the following points:

1. the content of C element in the cast strips is reduced to a level being equal to or below 30 ppm, the negative impact on the plasticity after the formation of C element segregation into $Fe_3C$ is eliminated, the decarburization procedure before high-temperature annealing is omitted, and there the primary recrystallization technology difficulty is greatly simplified;

2. through the solution of Mn, S, Al, V, Nb and especially N elements, the impact of long-range order of a $DO_3$ phase on plasticity is strongly prevented, and interstitial atoms N can significantly increase the shear deformation in the crystal to improve the plasticity deformation capacity of the matrix;

3. in the control method of inhibitors in the matrix: elements S and N in inhibitors are solution elements and when N is greater than or equal to 100 ppm in the normal procedure, blistering and other defects are easy to occur, but the thin strip casting procedure can significantly improve the solid solution quantity of N; the solid solution quantity in the matrix is directly related to the over-cooled liquid steel in solidification; when the Si element is increased in near-rapid solidification course, the solid-liquid phase line is lowered, and therefore, a greater number of elements S and N can perform solution; the cooling rate is faster ($10^2$~$10^3$ DEG C./s), so that the two can be evenly distributed.

4. a part of MnS particles in size of 20-200 nm precipitated during solidification of the molten steel can significantly impede the grain boundary migration behavior of the cast strips after being solidified, thus greatly refining the crystalline grains of the cast strips and improving the low-temperature molding property of the high silicon steel cast strips, which is the unique characteristics of thin strip casting course;

5. by using decomposable compounds as inhibitors, such as the second-phase particles of MnS and (Al, V, Nb) N series in the heating course, the growth behavior of initial crystalline grains can be strongly inhibited, thus providing a stable matrix so as to obtain uniform, well-developed and accurately oriented Goss crystalline grains; also, after the completion of secondary recrystallization, purification annealing can be conducted with pure $H_2$, to discharge the S and N elements from the matrix, so that Mn, Al, V and Nb only exist in the matrix in the form of solution, to prevent compounds like TiN having high decomposition temperature causing many residues, and also to prevent the increased coercivity caused by antiphase boundary energy resulting from the uneven distribution of grain boundary segregation elements like B in the matrix, thereby reducing the coercive force in magnetization course so as to decrease the iron loss;

6. on the staged suppression strategy of composite inhibitors: N elements in low temperature hot rolling and warm rolling stages as well as remaining C elements in the matrix form (V, Nb) C and a small amount of (V, Nb) N, return and recrystallization during hot rolling are suppressed, the formed fiber tissue improves the plasticity of the matrix and refines the crystalline grains, and a stable matrix is provided for secondary recrystallization; (V, Nb) C is decomposed in the primary recrystallization course, so most C elements are broken off, to form (V, Nb) N which is decomposed in high-temperature annealing course, is acted as nuclei-formation particles of AlN particles, and further promotes the precipitation of AlN particles; AlN is matched with MnS as the compound inhibitor so as to maintain the restraining force on the matrix, so that the secondary recrystallization occurs at higher temperature, resulting in high orientation-degree Goss secondary crystalline grains and improving magnetic properties;

7. Hi-B oriented high silicon steel is achieved. In conventional processes, through the design of inhibitors, the inhibition force of 3% Si oriented silicon steel can be improved to obtain magnetic induction $B_8$ value above 1.90, then the obtained product is called as Hi-B oriented silicon steel, the ratio of the magnetic induction value to the theoretical saturation value is $B_8/B_S$: 1.90/2.03=0.94; on the other hand, second-phase particles formed in several stages at 10-60 nm and uniformly distributed in the primary recrystallization structure are acted as an inhibitor and strongly block the primary recrystallization of the high silicon matrix; as the temperature for high-temperature annealing rises, the exactly oriented Goss crystalline grains in the matrix grow significantly and develop into a sound secondary recrystallized structure, with iron loss value at or close to the level reported in Japanese patents, $B_8$ value above 1.74 T, $B_8/B_S$=1.74 T/1.80 T=0.967, and far more over the magnetic induction reported by Japanese patents; and 8. the restraining force and the comprehensive regulatory capacity are improved, and preparing 0.10-0.25 mm thin oriented high silicon steel is facilitated, so that lower iron loss is obtained.

DETAILED DESCRIPTION OF THE PREFERRED EMBODIMENT

The thin strip caster adopted in Embodiments disclosed by the present invention is that disclosed in Chinese Patent publication No. CN103551532A.

Figure 1:
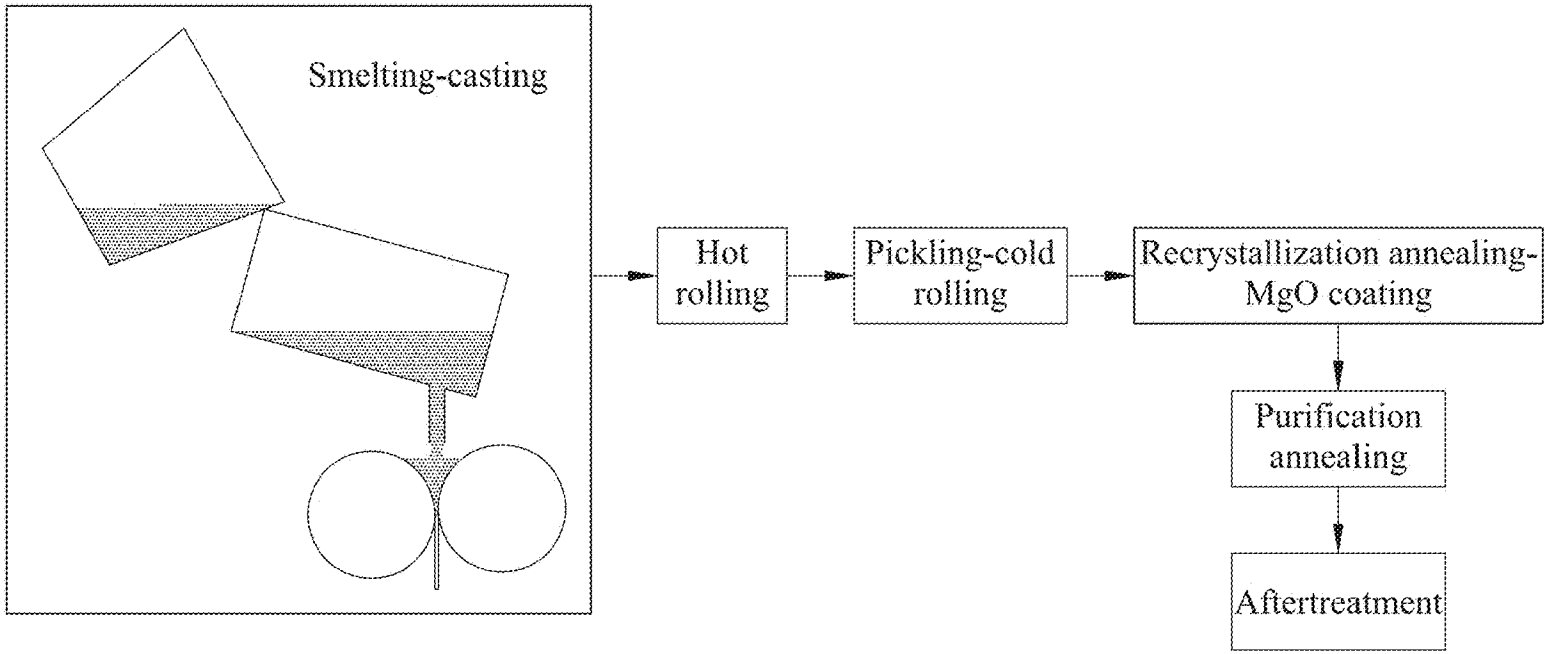
FIG. 1 is a schematic diagram of a preparation method of oriented high silicon steel disclosed by the present invention.
Figure 2:
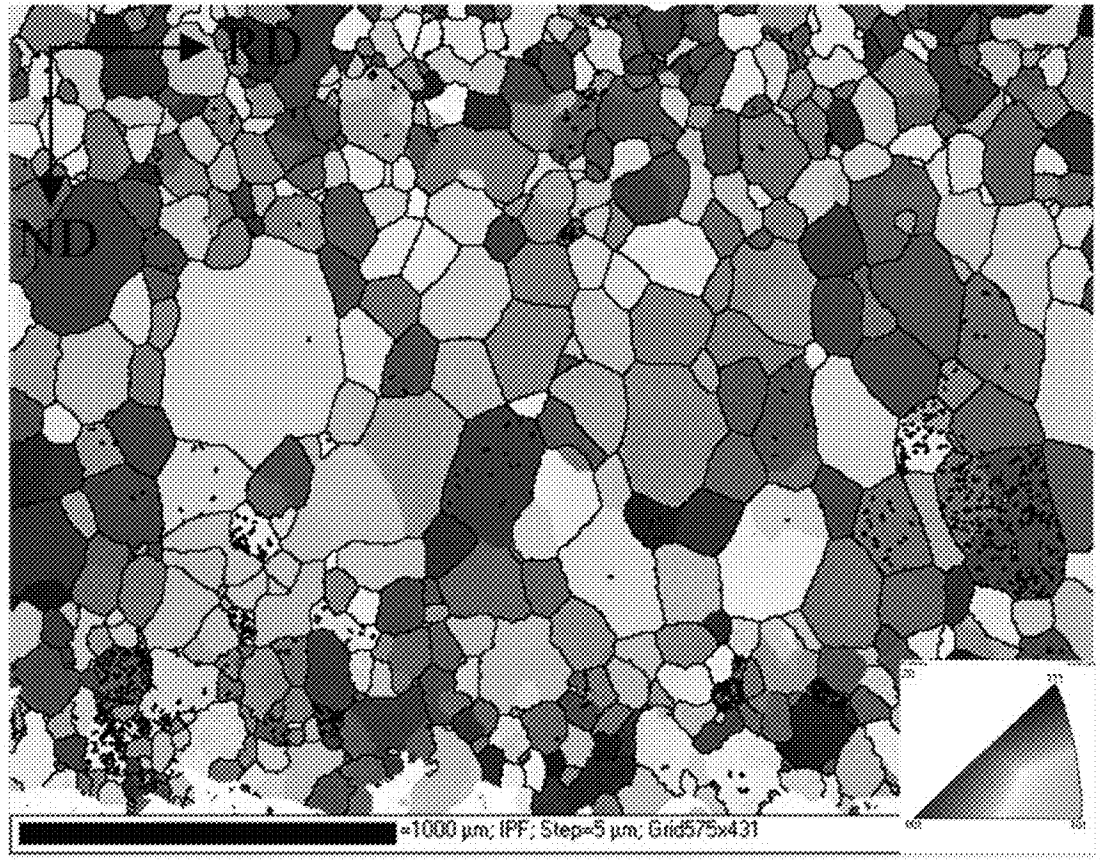
FIG. 2 is a microstructure micrograph of the product in Embodiment 3 disclosed by the present invention.
Figure 3:
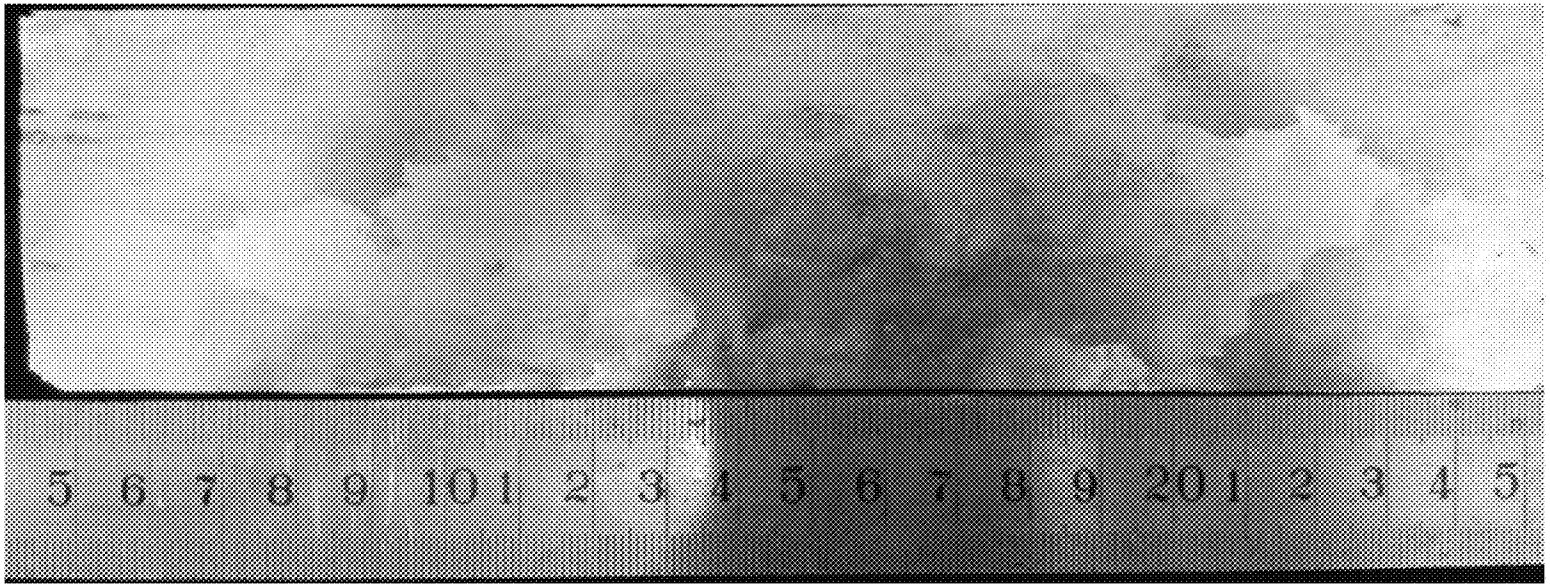
FIG. 3 is a macrostructure chart of the cold-rolled strips after recrystallization annealing in Embodiment 3 disclosed by the present invention.
Figure 4:
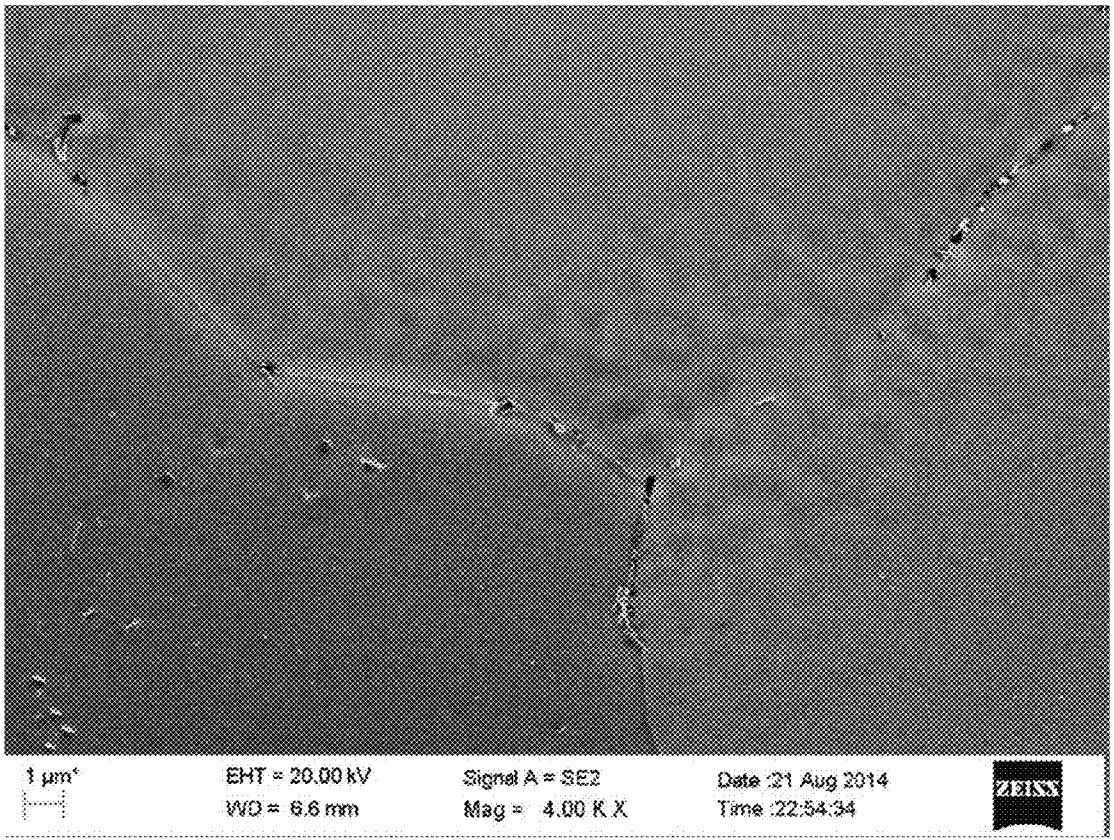
FIG. 4 is a microstructure micrograph of the cast strips in Embodiment 3 disclosed by the present invention; precipitation of MnS particles with the size of 20-200 nm is shown in the figure.

The preparation method of oriented high silicon steel in embodiments disclosed by the present invention based on a thin strip casting technique is shown in FIG. 1: molten steel smelted from a ladle is poured into a tundish, and flows into a thin strip caster from a feeding nozzle, so that a molten pool is formed in the crystallizer formed by two rotating casting rolls and side block panels and the molten steel is solidified to form cast strips; after hot rolling for one time, the cast strips are coiled; low temperature hot and warm rolling are performed on the hot-rolled strips in a protective atmosphere, and then pickling cold rolling is performed; after completion of cold rolling, primary recrystallization annealing and MgO coating are performed, and then the high temperature annealing course is performed; after high temperature annealing, steel coils are coated with an insulation layer, the coated steel coils are stretched flat, and then the flat steel coils are coiled once more.

A Zeiss Ultra 55 scanning electron microscope is used for observing the microstructure in the embodiments disclosed by the present invention.

The purity of hydrogen adopted in the embodiments disclosed by the present invention is 99.9%.

The purity of nitrogen adopted in the embodiments disclosed by the present invention is 99.9%.

Embodiment 1

Smelting to obtain molten steel according to set components in percentage by weight: 0.001% of C, 6.6% of Si, 0.2% of Mn, 0.12% of Al, 0.01% of V, 0.06% of Nb, 0.02% of S, 0.020% of N, 0.0016% of O, and the balance being Fe and unavoidable impurities;

performing a thin strip casting course: enabling the molten steel to be charged from a gate into a tundish which is preheated at the temperature of 1200 DEG C., controlling the superheat temperature to be at 20 DEG C., and through the tundish, enabling the molten steel to enter a thin strip caster, to form a molten pool in the crystallizer formed by rotating casting rolls and side block panels, and to be solidified and formed, wherein the thickness is 2.0 mm;

after drawing out cast strips, cooling the cast strips to 1000 DEG C. at the cooling rate of 50-100 DEG C./s under inert atmosphere conditions, then performing hot rolling, wherein the primary rolling temperature is 1000 DEG C., the final rolling temperature is 900 DEG C., and the rolling reduction is 15%, and forming hot-rolled cast strips;

cooling the hot-rolled cast strips to 580 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 580 DEG C., and the total rolling reduction is 70%, and forming warm-rolled strips;

removing oxidized scales of the warm-rolled strips through pickling, and then performing cold rolling 6 times at 100-200 DEG C., wherein the total rolling reduction is 80%; during the cold rolling course, performing aging treatment 2 times, wherein the aging treatment temperature is 280 DEG C., and the duration is 300 s, and performing aging treatment each time between two adjacent cold rollings, so as to obtain cold rolled strips with the thickness of 0.10 mm;

performing recrystallization annealing on the cold rolled strips at 840-860 DEG C. for 120 s under the condition of nitrogen-hydrogen mixed atmosphere, wherein the dew point of the mixed atmosphere is controlled to be at 30 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1240 DEG C. at the rate of 30-40 DEG C./h, and keeping the temperature for 20 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.18 W/kg, $P_{10/400}$ at 6.75 W/kg, magnetic induction $B_8$ at 1.74 T, and $B_8/B_S$=0.961.

Embodiment 2

Smelting to obtain molten steel according to set components in percentage by weight: 0.003% of C, 5.0% of Si, 0.3% of Mn, 0.05% of Al, 0.04% of V, 0.03% of Nb, 0.03% of S, 0.009% of N, 0.0018% of O, and the balance being Fe and unavoidable impurities;

performing a thin strip casting course: enabling the molten steel to be charged from a gate into a tundish which is preheated at the temperature of 1250 DEG C., controlling the superheat temperature to be 50 DEG C., and through the tundish, enabling the molten steel to enter a thin strip caster, to form a molten pool in the crystallizer formed by rotating casting rolls and side block panels, and to be solidified and formed, wherein the thickness is 2.3 mm;

after drawing out cast strips, cooling the cast strips to 1050 DEG C. at the cooling rate of 50-100 DEG C./s under inert atmosphere conditions, then performing hot rolling, wherein the primary rolling temperature is 1050 DEG C., the final rolling temperature is 980 DEG C., and the rolling reduction is 10%, and forming hot-rolled cast strips;

cooling the hot-rolled cast strips to 600 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 600 DEG C., and the total rolling reduction is 70%, and forming warm-rolled strips;

removing oxidized scales of the warm-rolled strips through pickling, and then performing cold rolling 7 times at 100-200 DEG C., wherein the total rolling reduction is 60%; during the cold rolling course, performing aging treatment 3 times, wherein the aging treatment temperature is 320 DEG C., and the duration is 240 s, and performing aging treatment each time between two adjacent cold rollings, so as to obtain cold rolled strips of which the thickness is 0.25 mm;

performing recrystallization annealing on the cold rolled strips at 840-860 DEG C. for 180 s under the condition of nitrogen-hydrogen mixed atmosphere, wherein the dew point of the mixed atmosphere is controlled to be at 40 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1220 DEG C. at the rate of 30-40 DEG C./h, and keeping the temperature for 30 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.62 W/kg, $P_{10/400}$ at 9.5 W/kg, magnetic induction $B_8$ at 1.81 T, and $B_8/B_S$=0.978.

Embodiment 3

Smelting to obtain molten steel according to set components in percentage by weight: 0.002% of C, 6.5% of Si, 0.23% of Mn, 0.08% of Al, 0.02% of V, 0.05% of Nb, 0.026% of S, 0.018% of N, 0.0011% of O, and the balance being Fe and unavoidable impurities;

performing a thin strip casting course: enabling the molten steel to be charged from a gate into a tundish which is preheated at the temperature of 1210 DEG C., controlling the superheat temperature to be at 30 DEG C., and through the tundish, enabling the molten steel to enter a thin strip caster, to form a molten pool in the crystallizer formed by rotating casting rolls and side block panels, and to be solidified and formed, wherein the thickness is 1.8 mm;

after drawing out cast strips, cooling the cast strips to 1030 DEG C. at the cooling rate of 50-100 DEG C./s under inert atmosphere conditions, then performing hot rolling, wherein the primary rolling temperature is 1030 DEG C., the final rolling temperature is 940 DEG C., and the rolling reduction is 13%, and forming hot-rolled cast strips;

cooling the hot-rolled cast strips to 550 DEG C. at the cooling rate of 20-30 DEG C./s, coiling the cooled cast strips, then performing hot rolling/warm rolling on the coiled strips at low temperature under a nitrogen atmosphere condition, wherein the primary rolling temperature is 755-765 DEG C., the final rolling temperature is 550 DEG C., and the total rolling reduction is 70%, and forming warm-rolled strips;

removing oxidized scales of the warm-rolled strips through pickling, and then performing cold rolling 5 times at 100-200 DEG C., wherein the total rolling reduction is 62%; during the cold rolling course, performing aging treatment 2 times, wherein the aging treatment temperature is 320 DEG C., and the duration is 240 s, and performing aging treatment each time between two adjacent cold rollings, so as to obtain cold rolled strips of which the thickness is 0.18 mm;

performing recrystallization annealing on the cold rolled strips at 840-860 DEG C. for 160 s under the condition of nitrogen-hydrogen mixed atmosphere, wherein the dew point of the mixed atmosphere is controlled to be at 50 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, then heating the heated coated cold-rolled strips to 1120-1140 DEG C. at the rate of 10-20 DEG C./h, then heating the heated coated cold-rolled strips to 1230 DEG C. at the rate of 30-40 DEG C./h, and keeping the temperature for 24 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.22 W/kg, $P_{10/400}$ at 7.1 W/kg, magnetic induction $B_8$ at 1.76 T, and $B_8/B_S$=0.966.

Embodiment 4

Smelting to obtain molten steel according to set components in percentage by weight: 0.001% of C, 5.8% of Si, 0.29% of Mn, 0.10% of Al, 0.03% of V, 0.06% of Nb, 0.02% of S, 0.015% of N, 0.0017% of O, and the balance being Fe and unavoidable impurities;

performing a thin strip casting course: enabling the molten steel to be charged from a gate into a tundish which is preheated at the temperature of 1220 DEG C., controlling the superheat temperature to be at 40 DEG C., and through the tundish, enabling the molten steel to enter a thin strip caster, to form a molten pool in the crystallizer formed by rotating casting rolls and side block panels, and to be solidified and formed, wherein the thickness is 3.0 mm;

after drawing out cast strips, cooling the cast strips to 1050 DEG C. at the cooling rate of 50-100 DEG C./s under inert atmosphere conditions, then performing hot rolling, wherein the primary rolling temperature is 1050 DEG C., the final rolling temperature is 980 DEG C., and the rolling reduction is 15%, and forming hot-rolled cast strips;

cooling the hot-rolled cast strips to 570 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 570 DEG C., and the total rolling reduction is 80%, and forming warm-rolled strips;

removing oxidized scales of the warm-rolled strips through pickling, and then performing cold rolling 6 times at 100-200 DEG C., wherein the total rolling reduction is 70%; during the cold rolling course, performing aging treatment 3 times, wherein the aging treatment temperature is 280 DEG C., and the duration is 300 s, and performing aging treatment each time between two adjacent cold rollings, so as to obtain cold rolled strips with the thickness of 0.15 mm;

performing recrystallization annealing on the cold rolled strips at 840-860 DEG C. for 140 s under the condition of nitrogen-hydrogen mixed atmosphere, wherein the dew point of the mixed atmosphere is controlled to be at 60 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1240 DEG C. at the rate of 30-40 DEG C./h, and keeping the temperature for 20 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10150}$ at 0.34 W/kg, $P_{10/400}$ at 7.4 W/kg, magnetic induction $B_8$ at 1.77 T, and $B_8/B_S$=0.975.

Embodiment 5

Smelting to obtain molten steel according to set components in percentage by weight: 0.003% of C, 5.2% of Si, 0.27% of Mn, 0.06% of Al, 0.04% of V, 0.04% of Nb, 0.028% of S, 0.014% of N, 0.0018% of O, and the balance being Fe and unavoidable impurities;

performing a thin strip casting course: enabling the molten steel to be charged from a gate into a tundish which is preheated at the temperature of 1230 DEG C., controlling the superheat temperature to be at 40 DEG C., and through the tundish, enabling the molten steel to enter a thin strip caster, to form a molten pool in the crystallizer formed by rotating casting rolls and side block panels, and to be solidified and formed, wherein the thickness is 2.5 mm;

after drawing out cast strips, cooling the cast strips to 1000 DEG C. at the cooling rate of 50-100 DEG C./s under inert atmosphere conditions, then performing hot rolling, wherein the primary rolling temperature is 1000 DEG C., the final rolling temperature is 900 DEG C., and the rolling reduction is 12%, and forming hot-rolled cast strips;

cooling the hot-rolled cast strips to 580 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 580 DEG C., and the total rolling reduction is 75%, and forming warm-rolled strips;

removing oxidized scales of the warm-rolled strips through pickling, and then performing cold rolling 7 times at 100-200 DEG C., wherein the total rolling reduction is 67%; during the cold rolling course, performing aging treatment 2 times, wherein the aging treatment temperature is 300 DEG C., and the duration is 280 s, and performing aging treatment each time between two adjacent cold rollings, so as to obtain cold rolled strips of which the thickness is 0.18 mm;

performing recrystallization annealing on the cold rolled strips at 840-860 DEG C. for 180 s under the condition of nitrogen-hydrogen mixed atmosphere, wherein the dew point of the mixed atmosphere is controlled to be at 30 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1220 DEG C. at the rate of 30-40 DEG C./h, and keeping the temperature for 30 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.43 W/kg, $P_{10/400}$ at 8.2 W/kg, magnetic induction $B_8$ at 1.76 T, and $B_8/B_S$=0.965.

Embodiment 6

Smelting to obtain molten steel according to set components in percentage by weight: 0.002% of C, 6.1% of Si, 0.3% of Mn, 0.07% of Al, 0.01% of V, 0.05% of Nb, 0.02% of S, 0.020% of N, 0.0012% of O, and the balance being Fe and unavoidable impurities;

performing a thin strip casting course: enabling the molten steel to be charged through a gate into a tundish which is preheated at temperature of 1250 DEG C., controlling the superheat temperature to be at 50 DEG C., and through the tundish, enabling the molten steel to enter a thin strip caster, to form a molten pool in the crystallizer formed by rotating casting rolls and side block panels, and to be solidified and formed, wherein the thickness is 2.8 mm;

after drawing out cast strips, cooling the cast strips to 1030 DEG C. at the cooling rate of 50-100 DEG C./s under inert atmosphere conditions, then performing hot rolling, wherein the primary rolling temperature is 1030 DEG C., the final rolling temperature is 940 DEG C., and the rolling reduction is 15%, and forming hot-rolled cast strips;

cooling the hot-rolled cast strips to 560 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 560 DEG C., and the total rolling reduction is 75%, and forming warm-rolled strips;

removing oxidized scales of the warm-rolled strips through pickling, and then performing cold rolling 5 times at 100-200 DEG C., wherein the total rolling reduction is 80%; during the cold rolling course, performing aging treatment 3 times, wherein the aging treatment temperature is 300 DEG C., and the duration is 300 s, and performing aging treatment each time between two adjacent cold rollings, so as to obtain cold rolled strips of which the thickness is 0.12 mm;

performing recrystallization annealing on the cold rolled strips at 840-860 DEG C. for 160 s under the condition of nitrogen-hydrogen mixed atmosphere, wherein the dew point of the mixed atmosphere is controlled to be at 40 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, then heating the heated coated cold-rolled strips to 1120-1140 DEG C. at the rate of 10-20 DEG C./h, then heating the heated coated cold-rolled strips to 1230 DEG C. at the rate of 30-40 DEG C./h, and keeping the temperature for 24 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.29 W/kg, $P_{10/400}$ at 7.5 W/kg, magnetic induction $B_8$ at 1.74 T, and $B_8/B_S$=0.973.

Embodiment 7

Smelting to obtain molten steel according to set components in percentage by weight: 0.001% of C, 5.5% of Si, 0.22% of Mn, 0.11% of Al, 0.02% of V, 0.05% of Nb, 0.03% of S, 0.010% of N, 0.0018% of O, and the balance being Fe and unavoidable impurities;

performing a thin strip casting course: enabling the molten steel to be charged through a gate into a tundish which is preheated at the temperature of 1200 DEG C., controlling the superheat temperature to be at 20 DEG C., and through the tundish, enabling the molten steel to enter a thin strip caster, to form a molten pool in the crystallizer formed by rotating casting rolls and side block panels, and to be solidified and formed, wherein the thickness is 3.0 mm;

after drawing out cast strips, cooling the cast strips to 1050 DEG C. at the cooling rate of 50-100 DEG C./s under inert atmosphere conditions, then performing hot rolling, wherein the primary rolling temperature is 1050 DEG C., the final rolling temperature is 980 DEG C., and the rolling reduction is 15%, and forming hot-rolled cast strips;

cooling the hot-rolled cast strips to 600 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 600 DEG C., and the total rolling reduction is 70%, and forming warm-rolled strips;

removing oxidized scales of the warm-rolled strips through pickling, and then performing cold rolling 6 times at 100-200 DEG C., wherein the total rolling reduction is 76%; during the cold rolling course, performing aging treatment 2 times, wherein the aging treatment temperature is 280 DEG C., and the duration is 280 s, and performing aging treatment each time between two adjacent cold rollings, so as to obtain cold rolled strips of which the thickness is 0.18 mm;

performing recrystallization annealing on the cold rolled strips at 840-860 DEG C. for 140 s under the condition of nitrogen-hydrogen mixed atmosphere, wherein the dew point of the mixed atmosphere is controlled to be at 50 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1240 DEG C. at the rate of 30-40 DEG C./h, and keeping the temperature for 20 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.49 W/kg, $P_{10/400}$ at 7.8 W/kg, magnetic induction $B_8$ at 1.77 T, and $B_8/B_S$=0.968.

Embodiment 8

Smelting to obtain molten steel according to set components in percentage by weight: 0.003% of C, 5.8% of Si, 0.29% of Mn, 0.06% of Al, 0.03% of V, 0.05% of Nb, 0.021% of S, 0.017% of N, 0.0016% of O, and the balance being Fe and unavoidable impurities;

performing a thin strip casting course: enabling the molten steel to be charged from a gate into a tundish which is preheated at the temperature of 1220 DEG C., controlling the superheat temperature to be at 30 DEG C., and through the tundish, enabling the molten steel to enter a thin strip caster, to form a molten pool in the crystallizer formed by rotating casting rolls and side block panels, and to be solidified and formed, wherein the thickness is 1.8 mm;

after drawing out cast strips, cooling the cast strips to 1000 DEG C. at the cooling rate of 50-100 DEG C./s under inert atmosphere conditions, then performing hot rolling, wherein the primary rolling temperature is 1000 DEG C., the final rolling temperature is 900 DEG C., and the rolling reduction is 10%, and forming hot-rolled cast strips;

cooling the hot-rolled cast strips to 550 DEG C. at the cooling rate of 20-30 DEG C./s, coiling the cooled cast strips, then performing hot rolling/warm rolling on the coiled strips at low temperature under a nitrogen atmosphere condition, wherein the primary rolling temperature is 755-765 DEG C., the final rolling temperature is 550 DEG C., and the total rolling reduction is 70%, and forming warm-rolled strips;

removing oxidized scales of the warm-rolled strips through pickling, and then performing cold rolling 7 times at 100-200 DEG C., wherein the total rolling reduction is 70%; during the cold rolling course, performing aging treatment 3 times, wherein the aging treatment temperature is 320 DEG C., and the duration is 240 s, and performing aging treatment each time between two adjacent cold rollings, so as to obtain cold rolled strips of which the thickness is 0.15 mm;

performing recrystallization annealing on the cold rolled strips at 840-860 DEG C. for 120 s under the condition of nitrogen-hydrogen mixed atmosphere, wherein the dew point of the mixed atmosphere is controlled to be at 60 DEG C.; then coating with an MgO layer, and finally coiling so as to obtain coated cold-rolled strips, wherein the volume concentration of the hydrogen in the mixed atmosphere of nitrogen and hydrogen is 30%;

putting the coated cold-rolled strips into a ring furnace at 390-410 DEG C., under the hydrogen circulation condition, firstly heating the coated cold-rolled strips to 990-1010 DEG C. at the rate of 30-40 DEG C./h, heating the heated coated cold-rolled strips to 1120-1140 DEG C. at the rate of 10-20 DEG C./h, then heating the heated coated cold-rolled strips to 1220 DEG C. at the rate of 30-40 DEG C./h, and keeping the temperature for 30 h for purification annealing; and performing surface cleaning on the coated cold-rolled strips after purification annealing so as to remove the oxidized scales, then coating with an insulating layer, performing flat stretch annealing at 790-810 DEG C., and finally performing air-cooling to be at 650 DEG C. or below and coiling so as to obtain the oriented high silicon steel with magnetic properties: $P_{10/50}$ at 0.37 W/kg, $P_{10/400}$ at 7.2 W/kg, magnetic induction $B_8$ at 1.75 T, and $B_8/B_S$=0.970.

What is claimed is:

1. A preparation method of oriented high silicon steel, being performed according to the following steps of:

(1) smelting to obtain molten steel according to set components in percentage by weight: 0.001-0.003% of C, 5.0-6.6% of Si, 0.2-0.3% of Mn, 0.05-0.12% of Al, 0.01-0.04% of V, 0.03-0.06% of Nb, 0.02-0.03% of S, 0.009-0.020% of N, O which is less than or equal to 0.0020%, and the balance being Fe and unavoidable impurities;

(2) performing a thin-strip casting course: enabling the molten steel to be charged from a gate into a tundish which is preheated at the temperature of 1200-1250 DEG C., controlling the superheat temperature to be at 20-50 DEG C., and through the tundish, enabling the molten steel to enter a thin-strip casting machine and to be formed into cast strips of which the thickness is 1.8-3.0 mm;

(3) after drawing out cast strips, cooling the cast strips to 1000-1050 DEG C. at the cooling rate of 50-100 DEG C./s under inert atmosphere conditions, then performing hot rolling, wherein the primary rolling temperature is 1000-1050 DEG C., the final rolling temperature is 900-980 DEG C., and the rolling reduction is 10-15%, and forming hot-rolled cast strips;

(4) cooling the hot-rolled cast strips to 550-600 DEG C. at the cooling rate of 20-30 DEG C./s, coiling the cooled cast strips, then performing hot rolling/warm rolling on the coiled cast strips at low temperature under a nitrogen atmosphere condition, wherein the primary rolling temperature is 755-765 DEG C., the final rolling temperature is 550-600 DEG C., and the total rolling reduction is 70-80%, and forming warm-rolled strips;

(5) removing oxidized scales of the warm-rolled strips through pickling, and then performing cold rolling for multiple times at 100-200 DEG C., wherein the total rolling reduction is 60-80%; during the cold rolling course, performing aging treatment twice to 3 times, wherein the aging treatment temperature is 280-320 DEG C., and the duration is 240-300s, and performing the aging treatment each time between two adjacent cold rollings, so as to obtain cold rolled strips;

(6) performing recrystallization annealing on the cold rolled strips at 840-860 DEG C. for 120-180s under the condition of nitrogen-hydrogen mixed atmosphere, wherein the dew point of the mixed atmosphere is controlled at 30-60 DEG C., then coating with an MgO layer, and finally coiling so as to obtain coated cold-rolled strips;

(7) putting the coated cold-rolled strips into a ring furnace at 390-410 DEG C., under the hydrogen circulation condition, firstly heating the coated cold-rolled strips to 990-1010 DEG C. at the rate of 30-40 DEG C./h, then heating the heated coated cold-rolled strips to 1120-1140 DEG C. at the rate of 10-20 DEG C./h, then heating the heated coated cold-rolled strips to 1220-1240 DEG C. at the rate of 30-40 DEG C./h, and keeping the temperature for 20-30 h for purification annealing; and (8) performing surface cleaning on the coated cold-rolled strips after purification annealing so as to remove the oxidized scales, then coating with an insulating layer, performing flat stretch annealing at 790-810 DEG C., finally performing air-cooling to be at 650 DEG C. or below and coiling so as to obtain the oriented high silicon steel.

2. The preparation method of oriented high silicon steel of claim 1, wherein the thickness of the oriented high silicon steel is 0.10-0.25 mm.

3. The preparation method of oriented high silicon steel of claim 1, wherein the oriented high silicon steel has the following magnetic properties: $P_{10/50}$ at 0.18-0.62 W/kg, $P_{10/400}$ at 6.75-9.5 W/kg, magnetic induction $B_8$ at 1.74-1.81 T, and $B_8/B_S$=0.961~0.978.

* * * * *